US005862618A

United States Patent [19]

Brown

[11] Patent Number: 5,862,618

[45] Date of Patent: Jan. 26, 1999

[54] GUN SIGHT FOR SIGHTING MOVING TARGETS

[76] Inventor: Gary R. Brown, P. O. Box 216, Pittsfield, N.H. 03263

[21] Appl. No.: 845,066

[22] Filed: Apr. 21, 1997

[51] Int. Cl.[6] ..... F41C 3/14; F41G 1/32

[52] U.S. Cl. ..... 42/100; 33/241

[58] Field of Search ..... 42/100, 101, 102, 42/103; 33/241, 242, 243, 233; 362/110

[56] References Cited

U.S. PATENT DOCUMENTS

| | | | |
|---|---|---|---|
| 2,969,594 | 1/1961 | Palmer | 33/241 |
| 3,098,303 | 7/1963 | Plisk | 33/241 |
| 3,187,436 | 6/1965 | Friedrichsmeier | 42/100 |
| 3,641,676 | 2/1972 | Knutsen et al. | 42/100 |
| 3,820,248 | 6/1974 | Hayward | 33/241 |
| 4,458,463 | 7/1984 | Bohl . | |
| 4,574,335 | 3/1986 | Frimer | 33/241 |
| 4,745,698 | 5/1988 | Schwulst | 42/100 |
| 5,065,519 | 11/1991 | Bindon | 33/241 |
| 5,121,462 | 6/1992 | Fabre et al. | 385/143 |
| 5,359,800 | 11/1994 | Fisher et al. | 42/103 |
| 5,373,657 | 12/1994 | Betz et al. . | |
| 5,442,861 | 8/1995 | Lorocco | 33/241 |
| 5,471,777 | 12/1995 | McDonald . | |
| 5,638,604 | 6/1997 | Lorocco | 33/241 |

FOREIGN PATENT DOCUMENTS

| | | | |
|---|---|---|---|
| 470016 | 2/1992 | European Pat. Off. | 33/241 |
| 2154332 | 9/1985 | United Kingdom | 33/241 |

*Primary Examiner*—Charles Jordan
*Assistant Examiner*—Theresa M. Wesson
*Attorney, Agent, or Firm*—Stephen G. Matzuk

[57] ABSTRACT

An elongated opaque member having a longitudinal recess including a fluorescent mark at the distal end thereof viewable only by the shooting eye of the shooter when the elongated member is mounted at the proximal end of the gun barrel. The fluorescent mark typically comprises an elongated plastic member partially extending forward of the elongated opaque member, or alternately within the distal end of the elongated opaque member and revealed by an aperture provided within the elongated opaque member. Further alternate embodiments provide additional contrasting fluorescent material surrounding the fluorescent mark for enhanced sighting accuracy.

11 Claims, 2 Drawing Sheets

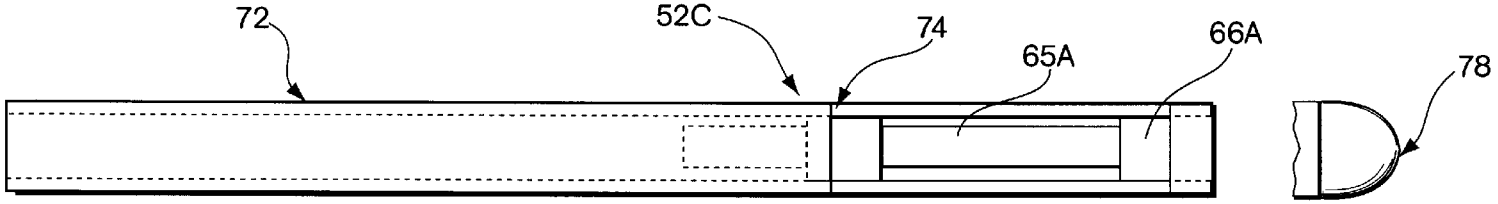
Fig. 4
Fig. 4B
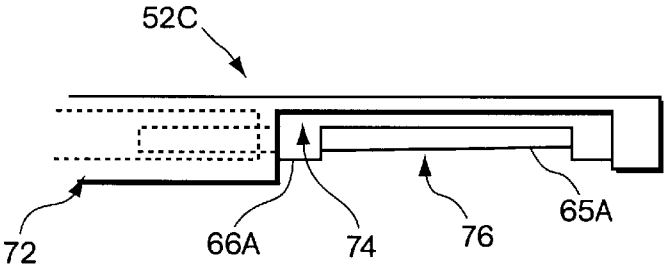
Fig. 4A
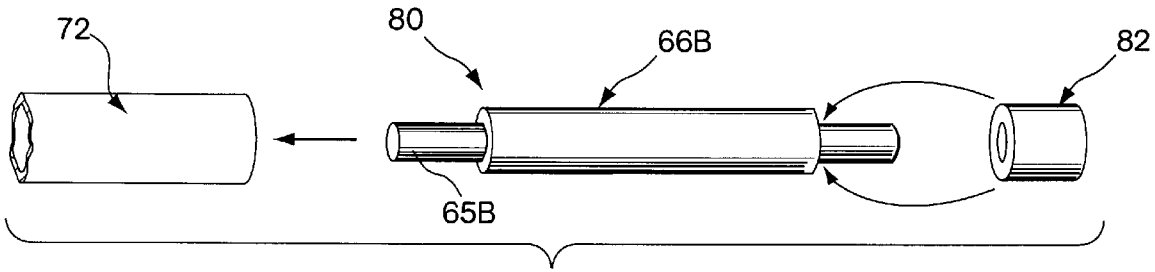
Fig. 5

GUN SIGHT FOR SIGHTING MOVING TARGETS

FIELD OF THE INVENTION

The present invention relates to sighting devices primarily for shotguns and hand guns, in particular to gun sights which provide an illuminated mark to indicate proper gun pointing at moving targets.

BACKGROUND OF THE INVENTION

As distinct from precision target shooting wherein the shooter takes precise aim of a target through a pair of sights disposed at the extremes of the gun barrel, a moving target shooter adopts a different strategy, of accurately "pointing" the gun barrel after raising, or "mounting" the gun. In less than 1½ seconds, the moving target, or "wing" shooter must first acquire the target in his view, second determine the proper position at which to point the gun. Simultaneously with acquiring the target, the shooter must mount the gun and acquire optimum pointing control of the gun. Moreover, it is preferable that while determining the proper position at which to point the gun, the gun is simultaneously pointed to that position and thereafter fired. However, traditional gun sights require the shooter to alternate between or compromise the target and gun related tasks, reducing accuracy.

Gun pointing aids such as single point sights located at the distal end of the barrel are intended to simplify the pointing process; however, as both eyes can see the same single point sight, it is instantly ambiguous which perceived point corresponds to the proper gun pointing. Attempts to interpose a lateral shield to cut off the view from the non-shooting eye are often ineffective during the mounting phase of shooting, and add little or nothing to aid the further optimization of pointing once the gun is mounted.

Sights mounted on the distal end of the gun barrel presenting an illuminated light having restricted range of viewing requires the shooter to limit the range of distal end gun motion and to fairly exactly point the gun barrel before the light begins to be seen. Alternately, a highly collimated light as may be provided by a long (>12") collimating tube delays or confuses the shooter by making it difficult to acquire the sight. Moreover, once seen, the light adds no further guidance on improving the pointing of the gun barrel, or precise targeting if sufficient time is available.

SUMMARY OF THE INVENTION

The present invention provides a shotgun or handgun pointing sight mountable on the barrel near the trigger housing comprising a fluorescent plastic member providing illumination according to the ambient light intensity, and a substantially surrounding member which provides a shooting eye indicator of optimum barrel alignment. In the preferred embodiment, an elongated tubular member contains a fluorescent plastic rod at its end and continuing forward of the end to receive light energy from the surrounding ambient light, which is then viewable from within the elongated tube by the shooting eye of the shooter when the shooter properly mounts and points the gun.

An further improvement according to the present invention comprises a multiple coaxially disposed plastic rod having contrasting fluorescent color plastic rods, wherein the inner rod extends proximally toward the shooter to offer the shooter varying fluorescent color patterns or intensities as the gun is moved to become optimally mounted by the shooter.

Still further embodiments provide an elongated tubular member to substantially surround the fluorescent rods to provide physical protection to the fluorescent plastic members. The tubular member includes one or more apertures to reveal the fluorescent plastic material to the ambient light.

Thus, according to the present invention, additional indicators by which shooter can effect the optimal mounting and pointing of the gun which provide the appropriate illumination for easy sighting and without the need for gun sight focusing.

BRIEF DESCRIPTION OF THE DRAWING

These and further features of the present invention will be better understood by reading the following Detailed Description together with the Drawing, wherein

FIG. 4 is an elevation view of a further alternate embodiment according to the present invention;

FIG. 4A is a plan view of the embodiment of FIG. 4;

FIG. 4B is a further alternate embodiment having a rounded, covered distal end of the embodiment of FIG. 4; and FIG. 5 is an partial exploded view of one embodiment of the present invention, including an optional night illumination source.

DETAILED DESCRIPTION OF THE INVENTION

Figure 1:
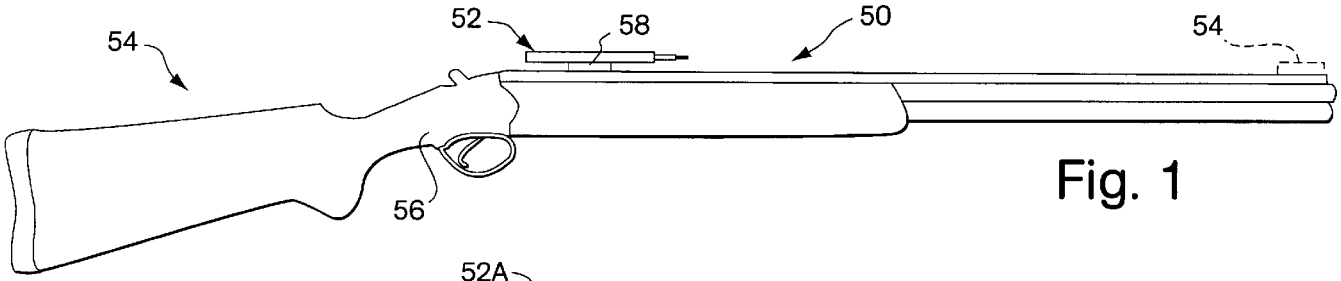
FIG. 1 is an exemplary view of a shotgun including the rearward mounted gun sight according to one embodiment of the present invention.

A shotgun 54 and gun sight 52 are shown together 50 in FIG. 1, wherein the gun sight 52 is mounted close to the trigger housing 56. A gun sight can be mounted at the distal end (tip) of the shotgun barrel, as illustrated in phantom, if desired. When the shooter mounts the gun, the rearward mounting of the sight encourages a more balanced raising of the shotgun by allowing the shooter to attend to a region closer to the center of the gun.

The rearward gun sight according to one embodiment 52A of the present invention includes a fluorescent plastic element partially received within an elongated member 64 which substantially surrounds the received portion of the fluorescent plastic element 62. The elongated member inner surface 61 has an non-reflective coating or is made substantially non-reflective. The distal end elevation view of FIG. 2D illustrates an extension 63 of the member 64 along one side fluorescent plastic material to restrict the view of the distal portion of the fluorescent material by a non-shooting (left) eye; the opposite shooting eye configurations provide extension 63 on the opposite side of the fluorescent plastic material 62. Typically, the elongated member comprises a tubular member, but also may comprise a C-shaped, rectangular-shaped cross-sectional member. A sight configured and mounted (with a suitable bow mounting device) on a shotgun/rifle has a length from the proximal end to the proximal end of the fluorescent plastic element 62 of 6–8 inches for a horizontally viewable end dimension of the fluorescent plastic member of less than 5/16 inch, or preferably a round pattern of 3/16 inch for a thin-walled (formed sheet metal) tubular member, and correspondingly less if the tubular member has a significant thickness. A sight configured for handgun or archery mounting has a length from the proximal end of the tubular member to the proximal end of the fluorescent plastic of 1½ to 3 inches and a horizontally viewable fluorescent plastic element in the 0.1 to 3/16 inch range, typically a round pattern of ⅛ inch diameter.

Figure 2:
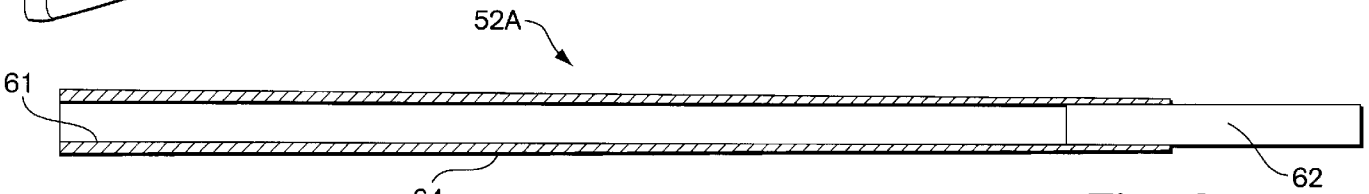
FIG. 2 is a cross-sectional elevation view of one embodiment of the gun sight according to one embodiment of the present invention.
Figures 2A, 2B, 2C, 2D:
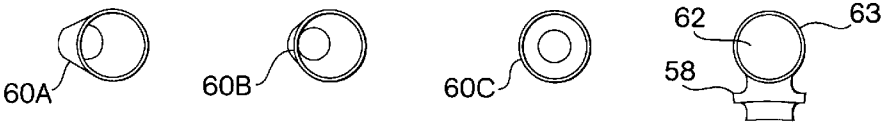
FIGS. 2A–2C are a sequence of perspective views of the proximal end of the embodiment of FIG. 2 as illustrated from the perspective of a lateral sighting motion.
FIG. 2D is an elevation of the distal end of one embodiment of the present invention.

When connected to the shotgun 54 (or handgun) by suitable fastening devices 58, the gun sight of FIG. 2 line of sight is in parallel alignment with the gun barrel providing the shooter with a sight mark viewable only by the shooting eye as shown in the FIGS. 2A–2C, as the gun is moved into optimum pointing position. The view 60A is observed when the gun is slightly laterally (to the right) displaced from optimum, and gradually, e.g. 60B, becomes optimal, 60C as the gun barrel and eye sighting line are moved into alignment.

Figure 3:
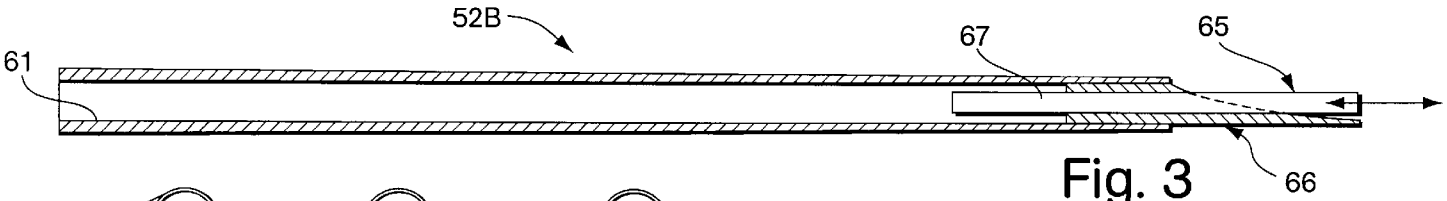
FIG. 3 is a cross-sectional elevation view of one embodiment of the gun sight according to one embodiment of the present invention.
Figures 3A, 3B, 3C:
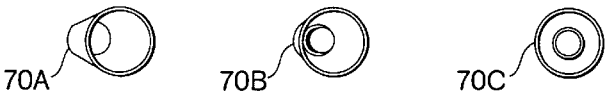
FIGS. 3A–3C are a sequence of perspective views of the proximal end of the embodiment of FIG. 3 as illustrated from the perspective of a lateral sighting motion.

Similarly, the further improvement according to one embodiment 52B of the present invention as shown in FIG. 3 provides an inner 65 and outer 66 fluorescent contrasting plastic members of generally concentric circular configuration. The proximal end 67 of the inner fluorescent member 65 is cantilevered beyond the outer fluorescent member 66, wherein the exposed (cylindrical) surface may further provide a contrasting or non-fluorescent surface which is viewable to the shooter when the gun sight is non-optimally aligned, as discussed below. Optionally, the outer fluorescent plastic material 66 may be tapered or shaped to reveal the inner fluorescent material, permitting both fluorescent materials 65, 66 to receive the ambient light energy; alternately, the inner fluorescent material may extend beyond the outer fluorescent material. A further feature according to the present invention provides adjustment of the position and length of the inner fluorescent plastic member 65 to vary the relative intensity of the fluorescence of that member, and to provide a more greater inner extension 67 to provide enhanced indication of optimal positioning. Thus, the gun sight of FIG. 3 also provides the shooter with a sight mark viewable only by the shooting eye as shown in the FIGS. 3A–3C, as the gun is moved into optimum pointing position. The view 70A is observed when the gun is slightly laterally (to the right) displaced from optimum, and gradually, e.g. 70B, becomes optimal, 70C as the gun barrel and eye sighting line are moved into alignment.

The embodiment 52C of FIGS. 4 and 4A provides a tubular member 72 having a distal aperture 74 to reveal the fluorescent plastic member 66A, without requiring the fluorescent plastic members to extend beyond the distal end of the tubular member 72. When the inner fluorescent member 65A (or additional members, not shown) are included, the outer fluorescent plastic members, e.g. 66A, may be themselves include an aperture 76 to reveal the inner fluorescent plastic members to receive the ambient light energy. Alternatively, the inner fluorescent plastic member(s) may extend beyond the distal end of the tubular member 72.

An alternative distal end 78 of the tubular member 72 is shown in FIG. 4B, which provides a rounded end covering.

A partial, exploded view of one embodiment of the present invention including concentric fluorescent plastic members 65B and 66B, which are to be received in the distal end of the tubular member 72, is shown in FIG. 5. Also included is a cylindrical member 82 comprising a stored-light energy or self-energized source of illumination, e.g. tritium, which is received over the inner fluorescent plastic member 65B to provide illumination viewable on the inner surface(s) of the fluorescent plastic members 65B and 66B when the gun sight is optimally pointed. Also according to the present invention, a small lamp (not shown) may be mounted externally nearby to provide local 'ambient' illumination or illumination directly to the external surfaces of the fluorescent plastic material.

The preferred embodiment comprises exemplary fluorescent plastic members; however, for the purpose of the invention and the specification, such members shall include all optical material, e.g. transparent or translucent plastic or glass, etc., capable of receiving and retransmitting ambient light. These and further embodiments provided according to modifications and substitutions of one of ordinary skill in the art are considered to be within the scope of the present invention, which is not to be limited except by the claims which follow.

What is claimed is:

1. A gun sight, comprising:

a fluorescent plastic member having a proximal and a distal end; and an elongated member having a longitudinal bore having a proximal and a distal end, said bore being adapted to receive said fluorescent plastic member at the distal end of said bore and a peripheral wall including an aperture therethrough permitting said fluorescent plastic member to receive light energy from the ambient light, wherein said bore has a ratio of the length from a proximal end of the bore to the proximal end of the fluorescent plastic member to the horizontally viewable end dimension of the fluorescent plastic member, the ratio being between 15 and 42.

2. The gun sight of claim 1, wherein the length from a proximal end of the bore to the proximal end of the fluorescent plastic member is in the range of 6 to 8 inches and the horizontally viewable end dimension of the fluorescent plastic member is in the range of ⅛ to 5/16 inch.

3. The gun sight of claim 2, wherein the proximal end of the fluorescent plastic member is round.

4. The gun sight of claim 2, wherein said aperture is oriented to be viewable only by the shooting eye opposite eye.

5. The gun sight of claim 2, further including means for mounting said elongated member at the proximal end of the gun barrel.

6. The gun sight of claim 1, further including one of bow mounting means and handgun mounting means for retaining said elongated member.

7. The gun sight of claim 6, wherein the length from a proximal end of the bore to the proximal end of the fluorescent plastic member is in the range of 1.5 to 3 inches and the horizontally viewable dimension of the fluorescent plastic member is in the range of 0.1 to 3/16 inch.

8. A gun sight mounted to a gun barrel having an axis to be viewed by a shooter having a sighting line, comprising:

a first fluorescent plastic member having a viewable first dimensioned proximal end area;

a second fluorescent plastic elongated tubular member positioned adjacent to said first fluorescent plastic member, said second fluorescent plastic elongated tubular member, wherein said second fluorescent plastic member selectively extends further proximally from said first fluorescent plastic member proximal end area and extends along a line parallel to said gun barrel, revealing a second fluorescent plastic member proximal end viewable area thereof and revealing substantially all of said first fluorescent proximal end area when viewed along said line parallel to said gun barrel and gradually obscuring said first fluorescent plastic member as said line parallel said gun barrel is angularly displaced from the sighting line of the shooter;

an optical barrier means located laterally adjacent and affixed to said first fluorescent plastic elongated tubular member for obscuring said first and second fluorescent plastic members from the non-shooting eye of the shooter; and mounting means to provide parallel alignment of said line to the axis of said gun barrel.

9. The gun sight of claim 8, wherein said optical barrier means comprises a tubular optical barrier.

10. The gun sight of claim 8, wherein said first fluorescent plastic member comprises a thin first plastic member having a viewable end area concentric with said second fluorescent plastic member and a dimension less than ½ of the horizontally viewable area of said second fluorescent plastic member.

11. The gun sight of claim 8, wherein the proximal position of said second fluorescent plastic member is selectively adjustable along said line parallel said gun barrel to provide one of adjustable obscuring of said first fluorescent plastic member and of adjustable intensity of second fluorescent plastic member.

* * * * *